US005806587A

United States Patent [19]

Sasaki et al.

[11] Patent Number: 5,806,587

[45] **Date of Patent: *Sep. 15, 1998**

[54] HEAT EXCHANGER

[75] Inventors: Kenichi Sasaki; Rei Oikawa; Tomohiro Chiba; Jun Iwai, all of Isesaki, Japan

[73] Assignee: Sanden Corporation, Gunma, Japan

[ * ] Notice: The term of this patent shall not extend beyond the expiration date of Pat. No. 5,590,710.

[21] Appl. No.: 686,447

[22] Filed: Jul. 25, 1996

Related U.S. Application Data

[62] Division of Ser. No. 361,302, Dec. 21, 1994.

[30] Foreign Application Priority Data

Dec. 21, 1993 [JP] Japan ..... 5-346145

[51] Int. Cl.[6] ..... F28F 9/02

[52] U.S. Cl. ..... 165/174; 165/906; 165/DIG. 481

[58] Field of Search ..... 165/174, 906, 165/173, 153, 157

[56] References Cited

U.S. PATENT DOCUMENTS

| | | | |
|---|---|---|---|
| 1,903,125 | 3/1933 | Modine . | |
| 2,315,404 | 3/1943 | Dono . | |
| 2,356,919 | 8/1944 | Dono et al. | 165/173 |
| 4,501,321 | 2/1985 | Real et al. . | |
| 5,205,353 | 4/1993 | Willemsen et al. . | |
| 5,351,751 | 10/1994 | Cage et al. | 165/173 |
| 5,590,710 | 1/1997 | Sasaki et al. | 165/173 |

FOREIGN PATENT DOCUMENTS

| | | | |
|---|---|---|---|
| 2614980 | 11/1988 | France | 165/906 |
| 936354 | 12/1955 | Germany | 165/906 |
| 247498 | 10/1990 | Japan | 165/906 |
| 577746 | 5/1946 | United Kingdom . | |
| 592058 | 9/1947 | United Kingdom | 165/151 |
| 844466 | 8/1960 | United Kingdom | 165/906 |

*Primary Examiner*—Leonard R. Leo
*Attorney, Agent, or Firm*—Baker & Botts, L.L.P.

[57] ABSTRACT

A heat exchanger is provided with a first tank and a second tank. Heat transfer tubes are disposed between the tanks and are connected to the tanks to place the tanks in fluid communication. At least one of the tanks is divided into chambers by a partition. A reinforcement plate member is disposed in at least one of the first and the second tanks for reinforcing the tank to prevent deformation of the tank due to an increase of the pressure within the tanks. The reinforcement plate member is not connected to the partition.

1 Claim, 8 Drawing Sheets

HEAT EXCHANGER

This application is a division of application Ser. No. 08/361,302, filed Dec. 21, 1994 entitled "HEAT EXCHANGER".

BACKGROUND OF THE INVENTION

1. Field of the Invention

This invention relates to heat exchangers for use in an air conditioning system for a vehicles, and more particularly, to reinforcing means for reinforcing tanks against increasing pressure within such heat exchangers.

2. Description of the Prior Art

FIG. 1 shows a conventional heat exchanger used in an air conditioning system, such as an evaporator or a condenser. In FIG. 1, heat exchanger 10 has upper tank 101, lower tank 102, and heat exchanger core 103 disposed between upper tank 101 and lower tank 102. Heat exchanger core 103 has a plurality of heat transfer tubes 104 spaced from one another and disposed in parallel to one another. Upper tank 101 has upper wall 101*a* and lower wall 101*b*, which are united to each other. Upper tank 101 is divided into three chambers, such as first upper chamber 180, second upper chamber 190, and third upper chamber 200, by partition plates 31 and 32. Lower tank 102 is divided into two chambers, such as first lower chamber 210 and second lower chamber 220, by partition plate 33. Lower wall 101*b* of upper tank 101 and upper wall 102*a* of lower tank 102 are provided with a plurality of connection holes 101*c* and a plurality of connection holes 102*c*, respectively, for interconnecting a plurality of heat transfer tubes 104 therebetween. Inlet pipe 105 and outlet pipe 106 are connected to upper tank 101.

For example, a heat exchanger medium may be introduced via inlet pipe 105 into first upper chamber 180 and may flow down through heat transfer tubes 104 until it reaches first lower chamber 210 of lower tank 102. The medium then may flow back into second upper chamber 190 through heat transfer tubes 104.

Partition plate 31 includes a plurality of notched portions 31*a* formed with predetermined pitch, width, and depth. Partition plate 32 includes a notched portion not shown) formed in the center thereof. Further, upper tank 101 and lower tank 102, respectively, include a plurality of reinforcement plates 41 therein. Reinforcement plates 41 include notched portions 41*a* formed in the center thereof and a plurality of holes 41*b* therein. A plurality of holes 41*b* are formed with a predetermined number, pitch, and diameter, so that a heat exchanger medium may pass freely through holes 41*b* of reinforcement plates 41.

In a method for assembling upper tank 101 and lower tank 102, partition plate 32 is connected with partition plate 31 at right angles to each other, so that the notched portion (not shown) of partition plate 32 fixedly inserts into center notched portion 31*a* of partition plate 31. Thereafter, a plurality of reinforcement plates 41 may be connected with partition plate 31 at right angles, so that notched portions 41*a* of reinforcement plates 41 fixedly insert into notched portions 31*a* of partition plate 31 shown in FIGS. 3, 4 and 5, to prevent the movement thereof during brazing. Finally, assembled heat exchanger 10 may be placed in a brazing furnace, such that all of its parts may be simultaneously brazed together.

Further, referring again to FIG. 2, the heat exchanger medium flows from second upper chamber 190 of upper tank 101 through heat transfer tubes 104 and into second lower chamber 220 of lower tank 102 and then flows back to third upper chamber 200 through heat transfer tubes 104. When the heat exchanger medium flows through heat transfer tubes 104, heat is exchanged between the heat exchanger medium and air flow 17 passing across heat transfer tubes 104, as shown in FIG. 2.

Generally, in the arrangement described above, upper tank 101 and lower tank 102 easily expand outward due to increasing pressure within the heat exchanger because upper tank 101 and lower tank 102 are formed with flat surfaces. It may be possible to overcome this disadvantage by forming the upper wall and lower wall of the tanks with an uneven surface or forming the upper wall and lower wall with thick plate members to increase the pressure strength of tanks. However, this construction method requires making a complex and expensive working die, or increasing the net weight of the heat exchanger.

In view of these disadvantages, the tanks may be provided with at least one reinforcement plate, such as reinforcement plate 41, and reinforcement plate 41 may be secured to the inner surface of the tanks by brazing to increase the internal pressure resistance of the tanks. Nevertheless, reinforcement plate 41 must be secured to partition plate 31 before brazing heat exchanger 10 in a brazing furnace to prevent movement of reinforcement plate 41. This process, however, is also complex and time consuming.

SUMMARY OF THE INVENTION

It is an object of this invention to manufacture a heat exchanger that has increased resistance to internal pressure without substantially increasing the manufacturing costs or the net weight of the heat exchanger. Further, it is an object of the invention to provide a heat exchanger wherein the assembly is accomplished by a simple and less time consuming process.

In this invention, a heat exchanger comprises a first tank and a second tank spaced apart from the first tank. A plurality of heat transfer tubes are disposed between the first tank and the second tank. Each of the heat transfer tubes has a first end and a second end. Each first end is connected to the first tank, and each second end is connected to the second tank. At least one partition is disposed within at least one of the first and the second tanks to divide the tank into at least two chambers. Reinforcing means are disposed in at least one of the first and the second tanks for preventing the deformation of the tanks due to an increase of pressure within the tanks and are independent of, e.g., not connected to, the partition.

Further objects, features and other aspects of this invention will be apparent from the detailed description of the invention and the accompanying drawings.

BRIEF DESCRIPTION OF THE DRAWINGS

For more complete understanding of the present invention and the objects features, and advantages thereof, reference is made to the following detailed description taken in conjunction with accompanying drawings, in which.

DETAILED DESCRIPTION OF THE DRAWINGS

Figure 1:
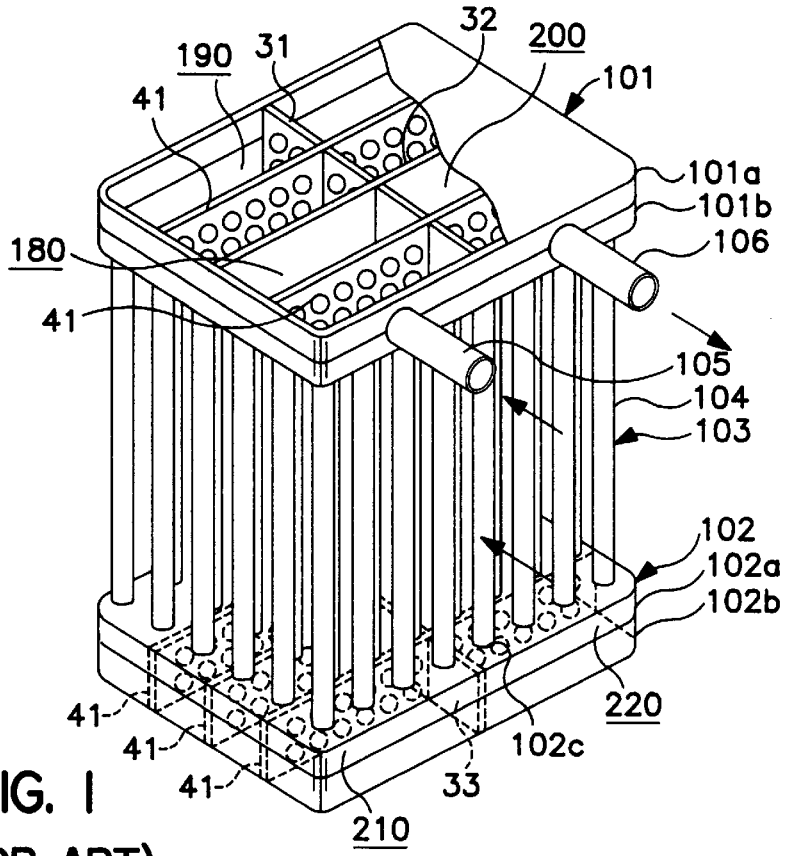
FIG. 1 (PRIOR ART)
FIG. 1 is a perspective view of a heat exchanger in accordance with a prior art.
Figure 2:
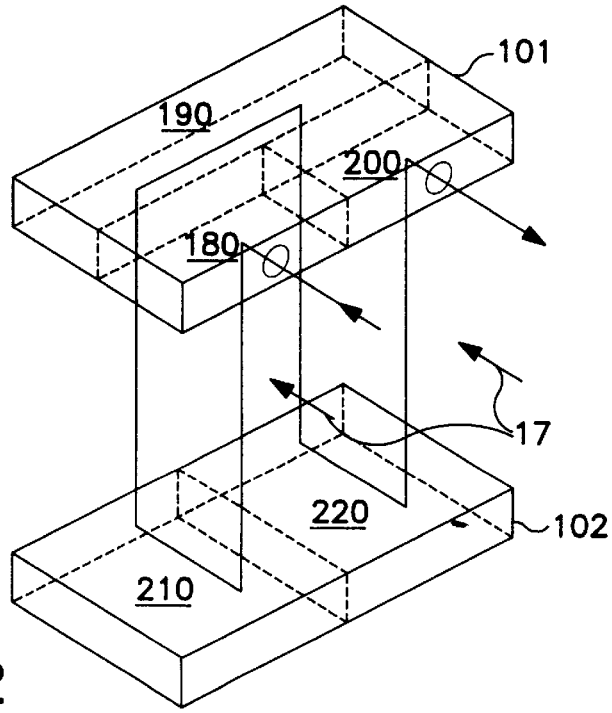
FIG. 2 (PRIOR ART)
FIG. 2 is a schematic perspective view of a conventional heat exchanger, showing an example of a heat exchanger medium flow path.
Figure 3:
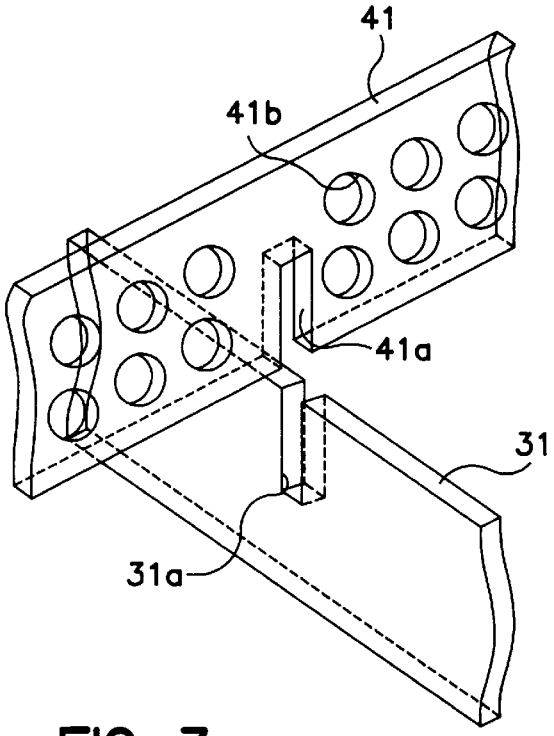
FIG. 3 (PRIOR ART)
FIGS. 3–4 are enlarged, partial, perspective views of certain elements of the heat exchanger in accordance with the prior art.
Figure 4:
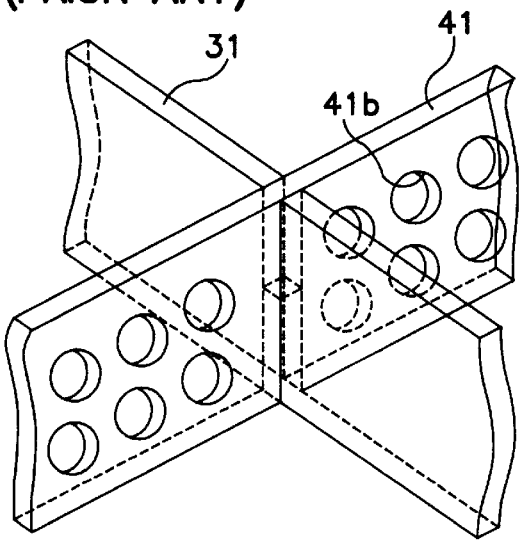
FIG. 4 (PRIOR ART)
Figure 5:
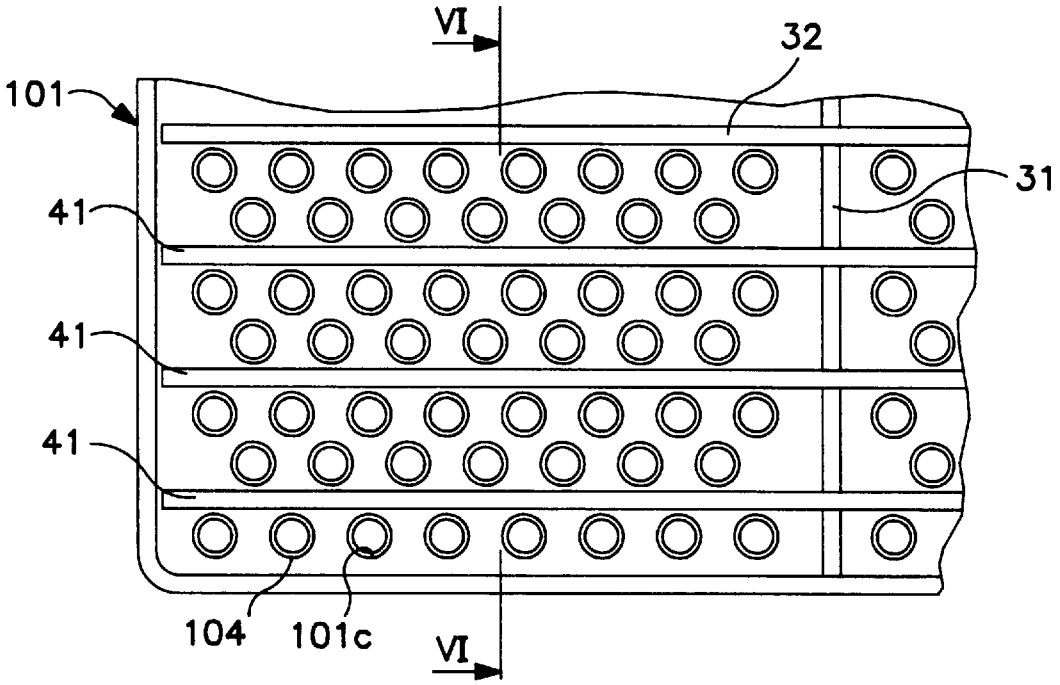
FIG. 5 (PRIOR ART)
FIG. 5 is an enlarged, partial, sectional view of a tank shown in FIG. 1.
Figure 6:
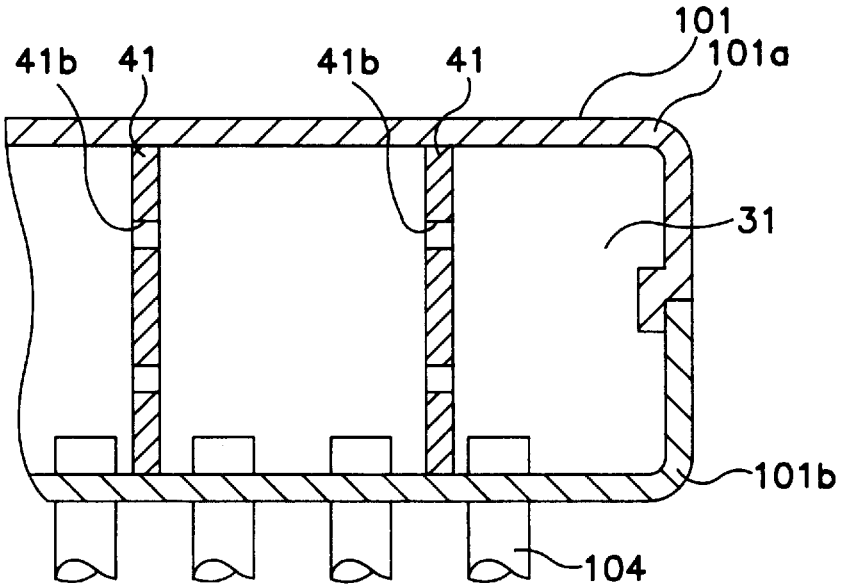
FIG. 6 (PRIOR ART)
FIG. 6 is an enlarged, sectional view taken along line VI—VI of FIG. 5.

FIGS. 7–21 depict heat exchangers according to the present invention. Parts of heat exchanger 10 are similar to those of FIG. 1. Therefore, similar parts are represented by the same reference numbers, and further detailed description of those parts is omitted.

Figure 7:
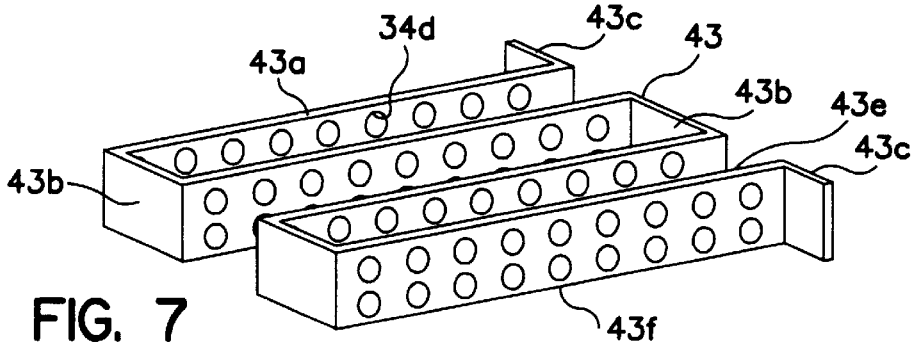
FIG. 7 is a perspective view of a reinforcement plate member in accordance with a first embodiment of the present invention.
Figure 8:
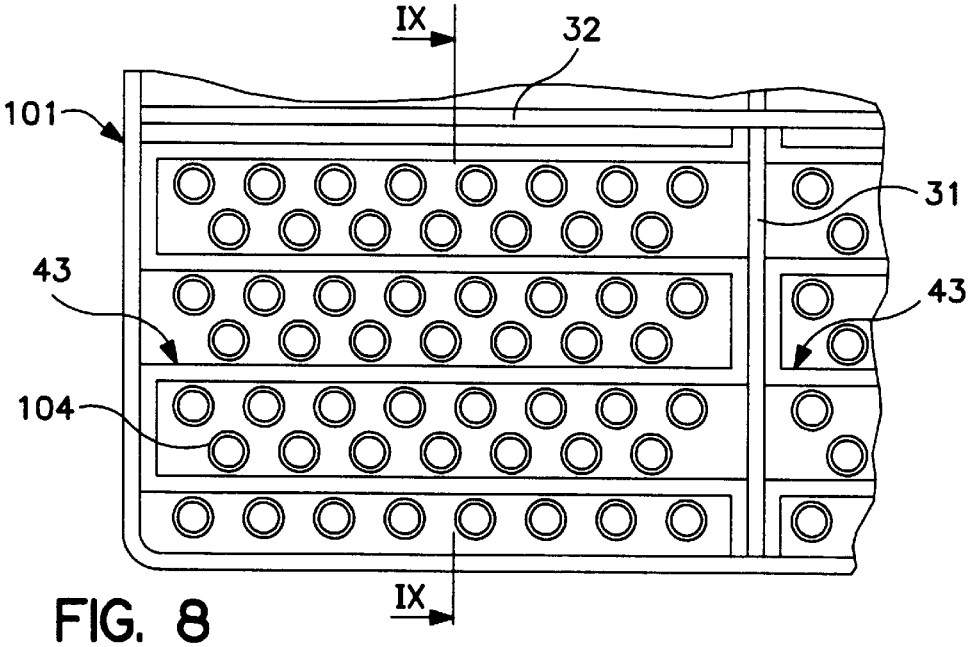
FIG. 8 is an enlarged, partial, sectional view of a tank in accordance with a first embodiment of the present invention.
Figure 9:
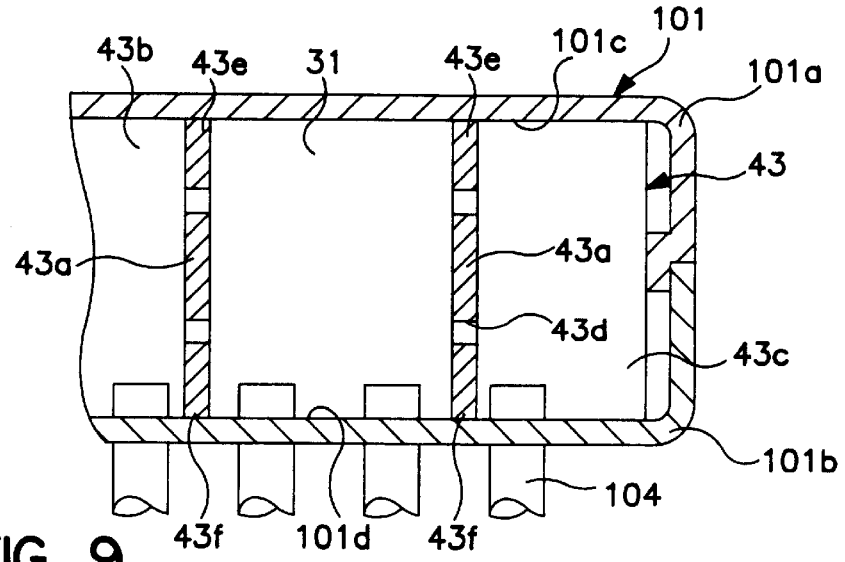
FIG. 9 is an enlarged, sectional view taken along line IX—IX of FIG. 8.

FIGS. 7, 8, and 9 illustrate a first embodiment of the invention. Reinforcement plate member 43 includes four first plate portions 43*a* and three second plate portions 43*b* perpendicularly joined to first plate portions 43*a*. Thus, four first plate portions 43*a* are aligned in parallel at regular intervals. One second plate portion 43*b* joins one end of two first plate portions 43*a*. Another second plate portion 43*b* joins the opposite end of one of first plate portions 43*a* to an end of another first plate portion 43*a*. Referring to FIG. 7, reinforcement plate member 43 is formed as a zigzagging structure by repeating the construction steps described above. Reinforcement plate member 43 also may include a plurality of first plate portions 43*a*, second plate portions 43*b*, and flange portions 43*c*. Further, each first plate portion 43*a* includes a plurality of holes 43*d* formed with a predetermined number, pitch, and diameter, so that a heat exchanger medium may pass freely therethrough. Moreover, each hole 43*d* may be shaped as a circle, a rectangle, or a triangle. In addition, reinforcement plate member 43 may be made of metal, for example, an aluminum-zinc (Al-Zn) or a copper alloy.

In assembling the tanks, reinforcement plate member 43 is placed in each chamber of upper tank 101 or lower tank 102 independent from, e.g., without being connected to, partition plates 31 and 32. Referring to FIG. 8, first plate portions 43*a* are arranged between the ends of heat transfer tubes 104 within the tank and parallel to partition plate 32 and second plate portions 43*b* are parallel to partition plate 31. Referring to FIG. 9, upper ends 43*e* and lower ends 43*f* of reinforcement plate member 43 are in contact with inner surface 101*c* of upper wall 101*a* and inner surface 101*d* of lower wall 101*b*, respectively, so that they may be brazed to each other. Finally, in assembling the tanks, reinforcement plate member 43 is integrally secured in a brazing furnace to both of upper wall 101*a* and lower wall 101*b* of upper tank 101, for example, by melting a brazing material lining the inner tank surfaces. Therefore, this improvement prevents upper tank 101 or lower tank 102 from expanding outwardly due to the pressure within the heat exchanger. As a result, a heat exchanger, which is provided with reinforcing means for preventing expansion of the tanks, may be produced by a simple process.

Figure 10:
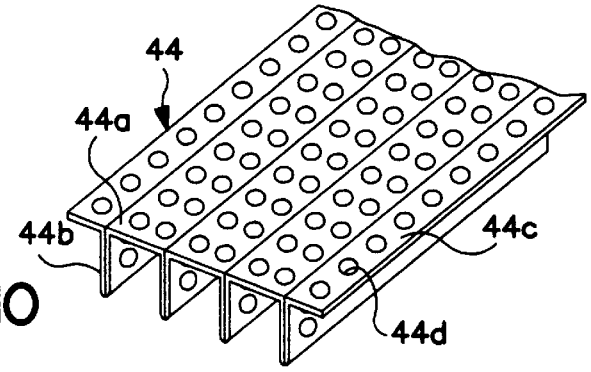
FIG. 10 is a perspective view of a reinforcement plate member in accordance with a second embodiment of the present invention.
Figure 11:
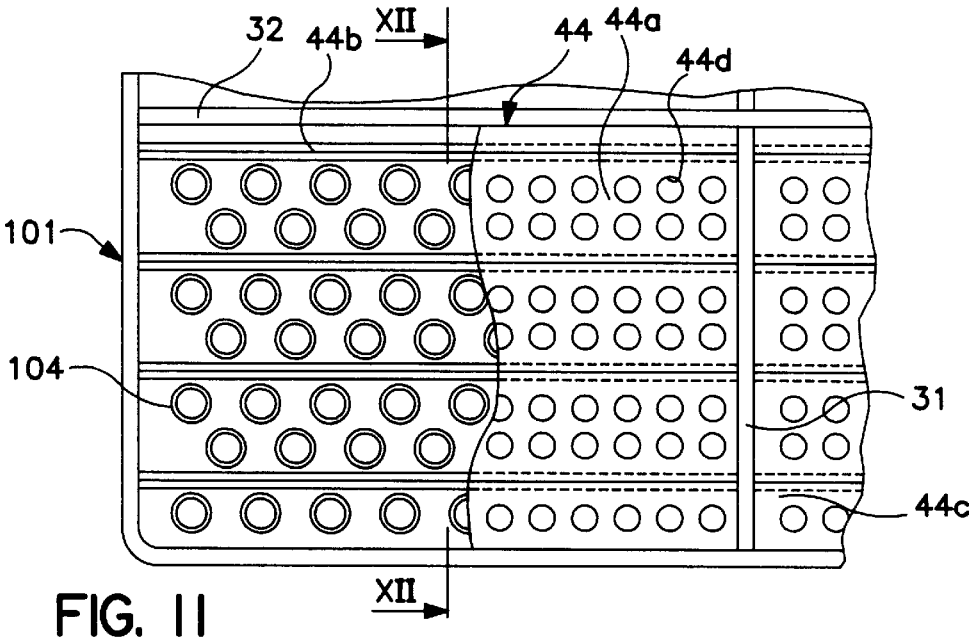
FIG. 11 is an enlarged, partial, sectional view of a tank in accordance with a second embodiment of the present invention.
Figure 12:
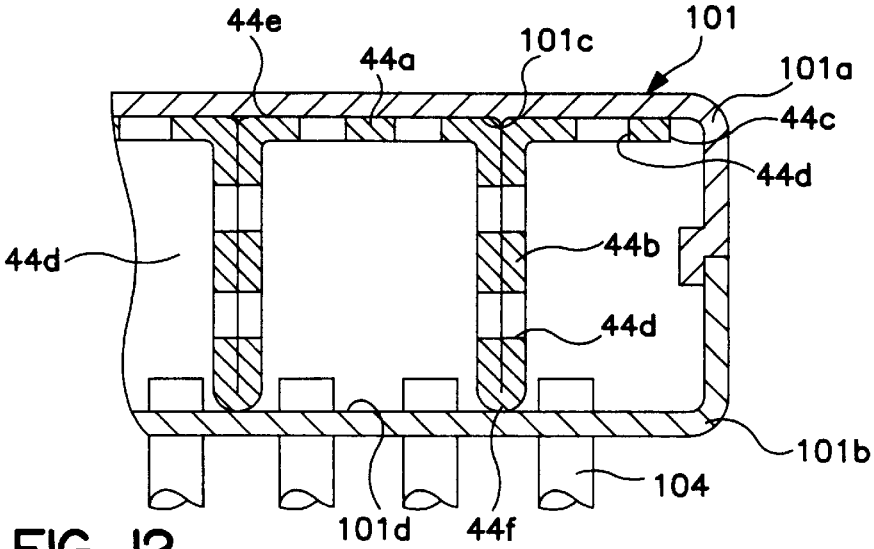
FIG. 12 is an enlarged, sectional view taken along line XII—XII of FIG. 11.

FIGS. 10, 11, and 12 illustrate a second embodiment of the invention. Reinforcement plate member 44 includes three first plate portions 44*a*, four second plate portions 44*b* that are perpendicular to first plate portions 44*a*, and two flange portions 44*c* that are perpendicular to and extend from second plate portions 44*b*. Thus, each second plate portion 44*b* is formed to be double layered by bending the plate member and has a plurality of holes 44*d* formed with a predetermined number, pitch, and diameter. Reinforcement plate member 44 may be assembled in each chamber of upper tank 101 or lower tank 102, so that second plate portions 44*b* are arranged between the ends of each row of heat transfer tubes 104 and parallel to partition plate 32, as shown in FIG. 11. Thus, reinforcement plate member 44 also may include a plurality of first plate portions 44*a*, second plate portions 44*b*, and flange portions 44*c*. Referring to FIG. 12, upper surface 44*e* and lower ends 44*f* of reinforcement plate member 44 are in contact with inner surface 101*c* of upper wall 101*a* and inner surface 101*d* of lower wall 101*b*, respectively, so that they may be brazed to each other.

Figure 13:
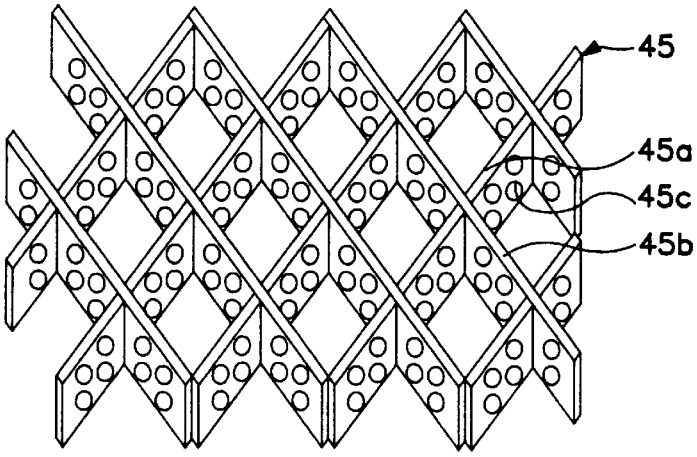
FIG. 13 is a perspective view of a reinforcement plate member in accordance with a third embodiment of the present invention.
Figure 14:
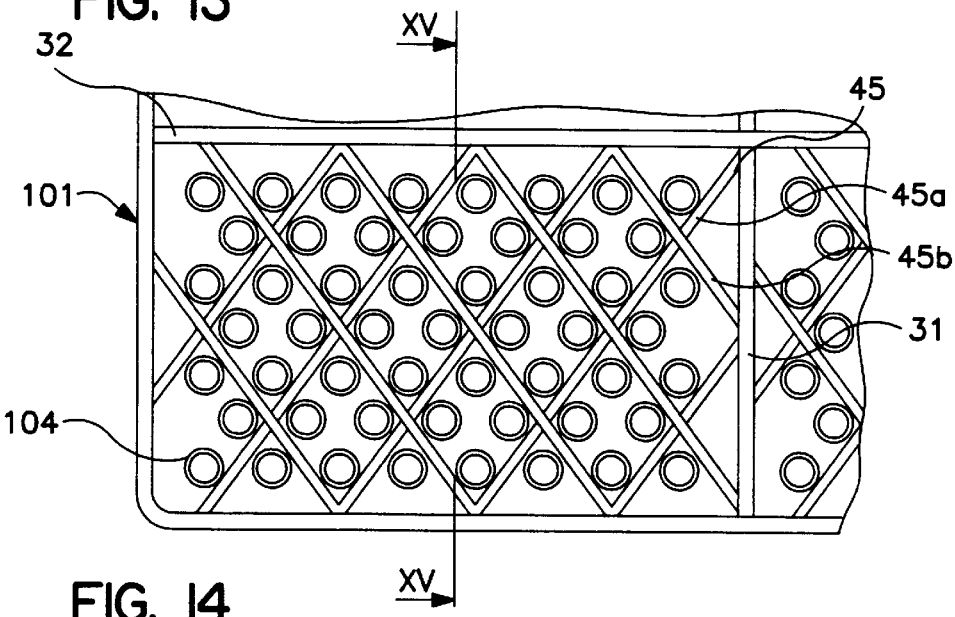
FIG. 14 is an enlarged, partial, sectional view of a tank in accordance with a third embodiment of the present invention.
Figure 15:
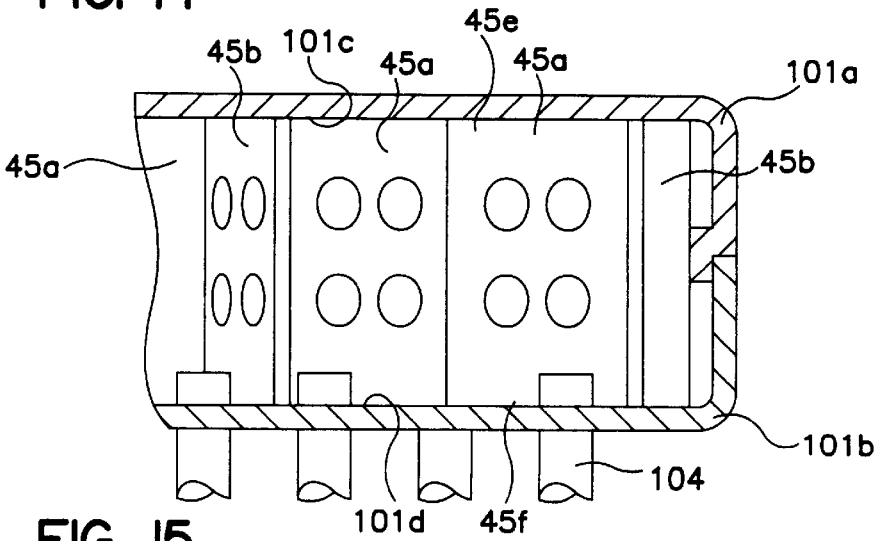
FIG. 15 is an enlarged, sectional view taken along line XV—XV of FIG. 14.

FIGS. 13, 14, and 15 illustrate a third embodiment of the invention. Reinforcement plate member 45 includes three first plate portions 45*a* and a plurality of second plate portions 45*b*, which are formed into a grid shape, as shown in FIG. 13. Each first plate portion 45*a* is connected to a plurality of second plate portions 45*b* in several places at regular intervals, so as to intersect second plate portions 45*b*. Both first plate portions 45*a* and second plate portions 45*b* include a plurality of holes 45*c* formed with a predetermined number, pitch, and diameter. According to FIG. 13, the external form of reinforcement plate member 45 is rectangular in shape, similar to that of a chamber of the tank. Reinforcement plate member 45 may be assembled in each chamber of upper tank 101 or lower tank 102, so that both of first plate portions 44*a* and second plate portions 44*b* are arranged between the ends of heat transfer tube 104 within the tank, as shown in FIG. 14. Referring to FIG. 15, upper ends 45*e* and lower ends 45*f* of reinforcement plate member 45 are in contact with inner surface 101*c* of upper wall 101*a* and inner surface 101*d* of lower wall 101*b*, respectively, so that they may be brazed to each other.

Figure 16:
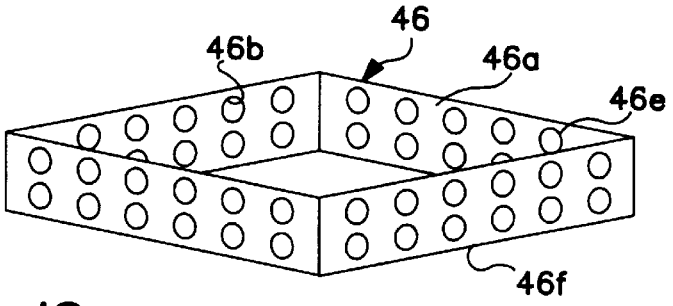
FIG. 16 is a perspective view of a reinforcement plate member in accordance with a fourth embodiment of the present invention.
Figure 17:
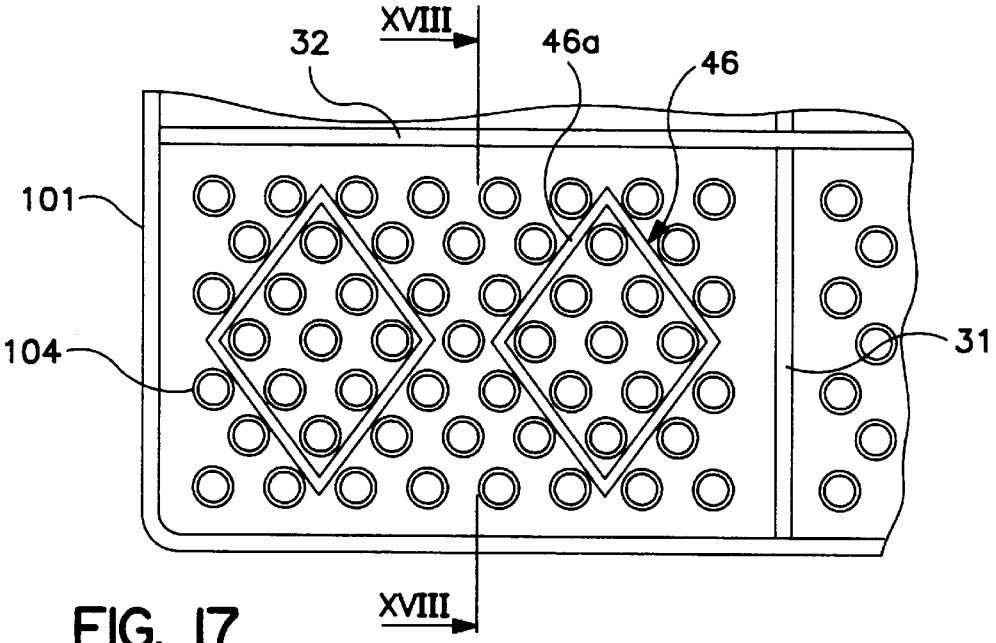
FIG. 17 is an enlarged, partial, sectional view of a tank in accordance with a fourth embodiment of the present invention.
Figure 18:
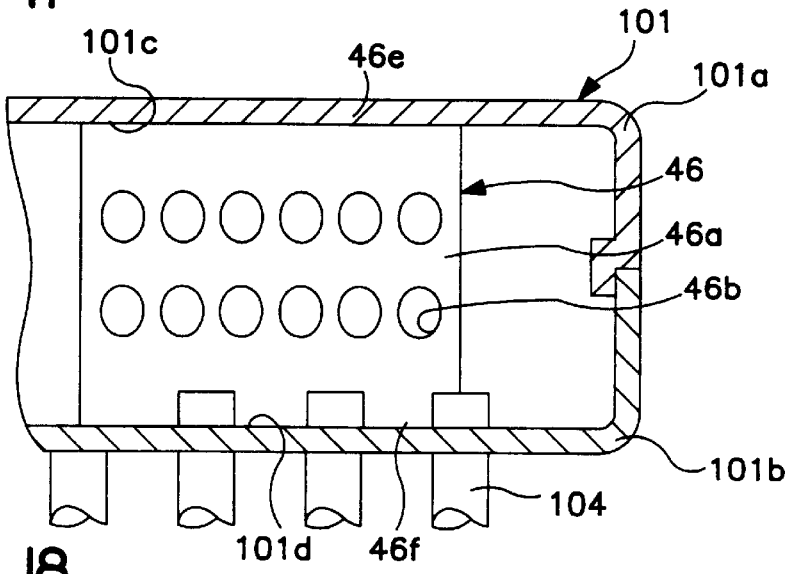
FIG. 18 is an enlarged, partial sectional view taken along line XVIII—XVIII of FIG. 17.

FIGS. 16, 17, and 18 illustrate a fourth embodiment of the invention.

Reinforcement plate member 46 includes four plate portions 46*a* joined to each other and is shaped as a quadrilateral, e.g., a diamond. Each plate portion 46*a* includes a plurality of holes 46*b* formed with a predetermined number, pitch, and diameter. A plurality of reinforcement plate members 46 may be placed in each chamber of upper tank 101 or lower tank 102 at regular intervals, so that plate portions 46*a* are arranged between the ends of heat transfer tubes 104, as shown in FIG. 17. Referring to FIG. 18, upper ends 46*e* and lower ends 46*f* of each reinforcement plate member 46 are in contact with inner surface 101*c* of upper wall 101*a* and inner surface 101*d* of lower wall 101*b*, respectively, so that they may be brazed to each other.

Figure 19:
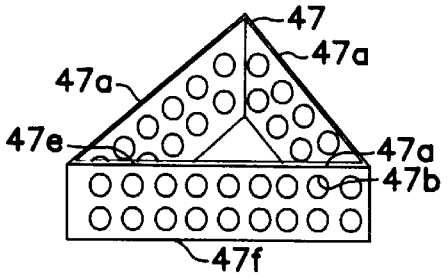
FIG. 19 is a perspective view of a reinforcement plate member in accordance with a fifth embodiment of the present invention.
Figure 20:
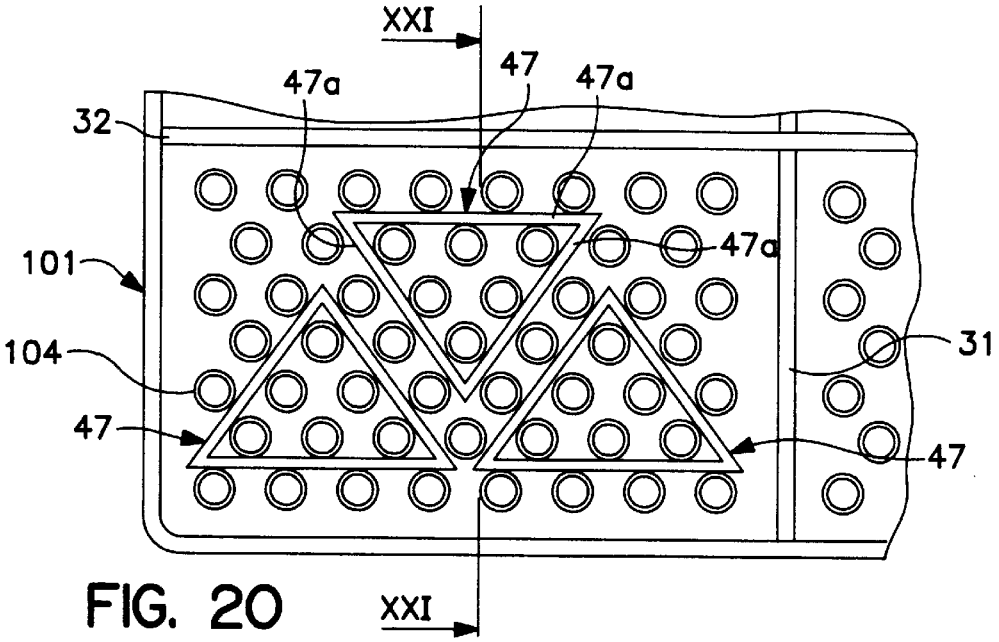
FIG. 20 is an enlarged, partial, sectional view of a tank in accordance with a fifth embodiment of the present invention.
Figure 21:
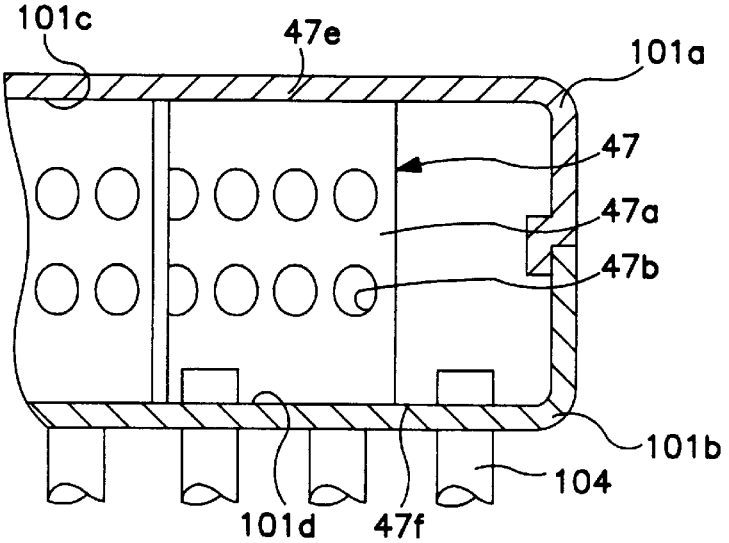
FIG. 21 is an enlarged, sectional view taken along line XXI—XXI of FIG. 20.

FIGS. 19, 20, and 21 illustrate a fifth embodiment of the invention. Reinforcement plate member 47 includes three plate portions 47*a* joined to each other and is shaped as a triangle. Plate portions 47*a* include a plurality of holes 47*b* formed with a predetermined number, pitch, and diameter. A plurality of reinforcement plate members 47 may be placed in each chamber of upper tank 101 or lower tank 102 at regular intervals, so that plate portions 47*a* are arranged between the ends of heat transfer tubes 104, as shown in FIG. 20. Referring to FIG. 21, upper ends 47*e* and lower ends 47*f* of reinforcement plates 47 are in contact with inner surface 101*c* of upper wall 101*a* and inner surface 101*d* of lower wall 101*b*, respectively, so that they may be brazed each other.

Both the function and effect of these embodiments are substantially the same as that of a first embodiment, so that further explanation thereof is omitted.

This invention has been described in detail in connection with preferred embodiments. These embodiments, however, are merely exemplary, and the invention is not restricted thereto. It will be easily understood by those skilled in the art that variations may be easily made within the scope of this invention as defined by the following claims.

We claim:

1. A heat exchanger comprising a first tank and a second tank spaced apart from said first tank; a plurality of heat transfer tubes, each having a first and a second end, disposed between said first tank and said second tank, wherein each first end of said plurality of heat transfer tubes is connected to said first tank and each second end is connected to said second tank; at least one partition disposed within at least one of said first and said second tanks to divide said tank into at least two chambers; and reinforcing means disposed in at least one of said first and said second tanks for preventing deformation of said tank due to an increase of pressure within said tank and independent of said partition, wherein said reinforcing means include at least one reinforcement plate member securely joining an upper wall of said tank to a lower wall of said tank and including a plurality of holes therethrough, through which said heat exchanger medium flows and wherein said plate member comprises a plurality of first plate portions having a plurality of holes therethrough, a plurality of second plate portions joined perpendicularly to said first plate portions, and flange portions extending from at least two of said first plate portions.

* * * * *